US008127773B2

(12) United States Patent
DiPippo

(10) Patent No.: US 8,127,773 B2
(45) **Date of Patent: *Mar. 6, 2012**

(54) SELF-CLEANING HAIR BRUSH WITH MIRROR

(76) Inventor: Joe DiPippo, Eastchester, NY (US)

( * ) Notice: Subject to any disclaimer, the term of this patent is extended or adjusted under 35 U.S.C. 154(b) by 720 days.

This patent is subject to a terminal disclaimer.

(21) Appl. No.: 12/189,478

(22) Filed: Aug. 11, 2008

(65) Prior Publication Data

US 2009/0013490 A1 Jan. 15, 2009

Related U.S. Application Data

(63) Continuation-in-part of application No. 11/823,733, filed on Jun. 28, 2007, now Pat. No. 7,739,769.

(51) Int. Cl.
*A45D 24/42* (2006.01)

(52) U.S. Cl. ..... 132/119; 15/169; 119/628

(58) Field of Classification Search ..... 132/119–124; 119/628, 600; 15/169, 246, 184, 160
See application file for complete search history.

(56) References Cited

U.S. PATENT DOCUMENTS

| | | | | |
|---|---|---|---|---|
| 1,280,204 | A | 10/1918 | Garber | |
| 1,303,500 | A | 5/1919 | Rosenberg | |
| 1,420,766 | A * | 6/1922 | Sims | 132/313 |
| 2,486,203 | A | 10/1949 | Pieper | |
| 2,916,757 | A | 12/1959 | Philip | |
| 3,059,260 | A | 10/1962 | Peilet | |
| 3,108,305 | A | 10/1963 | Peilet | |
| 3,110,053 | A | 11/1963 | Surabian | |
| 3,577,580 | A | 5/1971 | Rand | |
| 3,737,936 | A * | 6/1973 | Uosaki | 15/169 |
| 4,084,282 | A | 4/1978 | Calvert | |
| 4,517,703 | A | 5/1985 | Koke | |
| 5,267,528 | A | 12/1993 | Murieen, Sr. | |
| 5,519,912 | A * | 5/1996 | Kawamura | 15/160 |
| 5,862,563 | A | 1/1999 | Hartmann et al. | |
| 5,904,150 | A | 5/1999 | Caristo et al. | |
| 5,960,510 | A | 10/1999 | James et al. | |
| 6,427,633 | B1 * | 8/2002 | Ogden | 119/628 |
| 6,631,831 | B1 | 10/2003 | Loiselle | |
| 6,725,495 | B1 | 4/2004 | Habibi | |
| 2006/0000423 | A1 | 1/2006 | Morosin et al. | |
| 2007/0199170 | A1 | 8/2007 | DiPippo | |
| 2007/0261187 | A1 | 11/2007 | DiPippo | |

FOREIGN PATENT DOCUMENTS

WO WO-2007043043 A2 4/2007

OTHER PUBLICATIONS

International Search Report for PCT/US2009/052637, dated Mar. 5, 2010.

Written Opinion of the International Search Report for PCT/US2009/052637, dated Mar. 5, 2010.

* cited by examiner

*Primary Examiner* — Todd Manahan
*Assistant Examiner* — Brianne Kalach

(57) ABSTRACT

A hair brush with a cleaning element for removing entwined hair from the brush before or after use. The cleaning element of the brush includes a plate(s) with opening through which the bristles protrude. When the plate is expanded, the plate pushes any hairs entwined in the bristles to the tips of the bristles where they are removed. The brush also has a post mechanism, which allows for the adjustment of the cleaning element to various intermediary positions, effectively adjusting the length of the bristles for use of the brush. A mirror is provided on the back of the brush, on the reverse side from the bristles.

14 Claims, 8 Drawing Sheets

SELF-CLEANING HAIR BRUSH WITH MIRROR

CROSS-REFERENCE TO RELATED APPLICATION

This application is a continuation in part of U.S. patent application Ser. No. 11/823,733 filed Jun. 28, 2007, which is incorporated by reference herein in its entirety.

BACKGROUND OF THE INVENTION

1. Field of the Invention

The present invention relates to a self-cleaning hair brush that removes hair from the bristles of a hair brush in a thorough and convenient manner.

2. Description of Related Art

Hair brushes are notoriously difficult to clean. The more bristles a brush has, perhaps the more effective the brush is as a tool, but also, the more difficult it is to clean. The use of brushes with self-cleaning capabilities of known designs and configurations is known in the prior art. More specifically, brushes with self-cleaning capabilities of known designs and configurations previously devised and utilized for the purpose of cleaning matter from the bristles of brushes through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,631,831 to Loiselle discloses a retractable bristle brush for removing hair from hair brushes. U.S. Pat. No. 5,862,563 to Hartmann discloses a removable cleaning plate for removing hair from hair brushes. U.S. Pat. No. 4,084,282 to Calvert discloses a power operated rotary brush for removing hair from hair brushes. While these devices fulfill their respective, particular objectives and requirements, the aforementioned patents do not describe a self-cleaning hair brush that allows automatically removing hair from the bristles of a hair brush in a thorough and convenient manner.

In this respect, the self-cleaning hair brush according to the present invention substantially departs from the conventional concepts and designs of the prior art, and in doing so provides an apparatus primarily developed for the purpose of automatically removing hair from the bristles of a hair brush in a thorough and convenient manner.

Therefore, it can be appreciated that there exists a continuing need for a new and improved self-cleaning hair brush, which can be used for automatically removing hair from the bristles of a hair brush in a thorough and convenient manner. In this regard, the present invention substantially fulfills this need.

SUMMARY OF THE INVENTION

In view of the foregoing disadvantages inherent in the known types of brushes with self-cleaning capabilities of known designs and configurations now present in the prior art, the present invention provides an improved self-cleaning hair brush. As such, the general purpose of the present invention, which will be described subsequently in greater detail, is to provide a new and improved self-cleaning hair brush, which has all the advantages of the prior art and none of the disadvantages.

To attain this, the present invention is a hair brush with sliding parts (cleaning element) for hair removal. The hair brush has a brushing element supporting a plurality of bristles and a cleaning element having openings through which the bristles protrude. To use the brush, the cleaning element can be positioned at various distances from the brushing element to affect long or short bristles. To clean the hair brush, the cleaning element is filly extended (maximum cleaning position) away from the brushing element so that any hairs entwined in the bristles are forced to or off the tips of the bristles. The brushing element has a hollow body and the cleaning element is supported by a plate lifter(rib arm) which is attached to the control element/slide plate that is disposed within the brushing elements hollow body. The brush includes a mirror attached thereto on a side opposite the bristles. The mirror can extend along the length of the brush, including the handle. The mirror can be used to assist in grooming while using the brush.

The brush has a control element/slide plate used for adjusting the cleaning element to the various brushing positions and the cleaning position. Adjustments of the control element/slide plate, moves the cleaning element relative to the brushing element. Specifically, the control element/slide plate pulls the plate lifter (rib arm) within the brushing element propelling outward or inward until the cleaning element is in the desired position relative to the bristles.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self-cleaning hair brush, which has all of the advantages of the prior art brushes with self-cleaning capabilities of known designs and configurations and none of the disadvantages.

It is another object of the present invention to provide a new and improved self-cleaning hair brush, which may be easily and efficiently manufactured and marketed.

It is further object of the present invention to provide a new and improved self-cleaning hair brush, which is of durable and reliable constructions.

It is a further object of the present invention to provide a new and improved self-cleaning hair brush, which includes a mirror.

An even further object of the present invention is to provide a new and improved self-cleaning hair brush which is susceptible of a low cost of manufacture with regard to both materials and labor, and which accordingly is then susceptible of low prices of sale to the consuming public, thereby making such self-cleaning hair brush economically available to the buying public.

The above, and other objects, features and advantages of the present invention will become apparent from the following description read in conduction with the accompanying drawings, in which like reference numerals designate the same elements.

BRIEF DESCRIPTION OF THE DRAWINGS

The same reference numerals refer to the same parts throughout the various Figures.

DETAILED DESCRIPTION OF THE PREFERRED EMBODIMENTS

Figure 1:
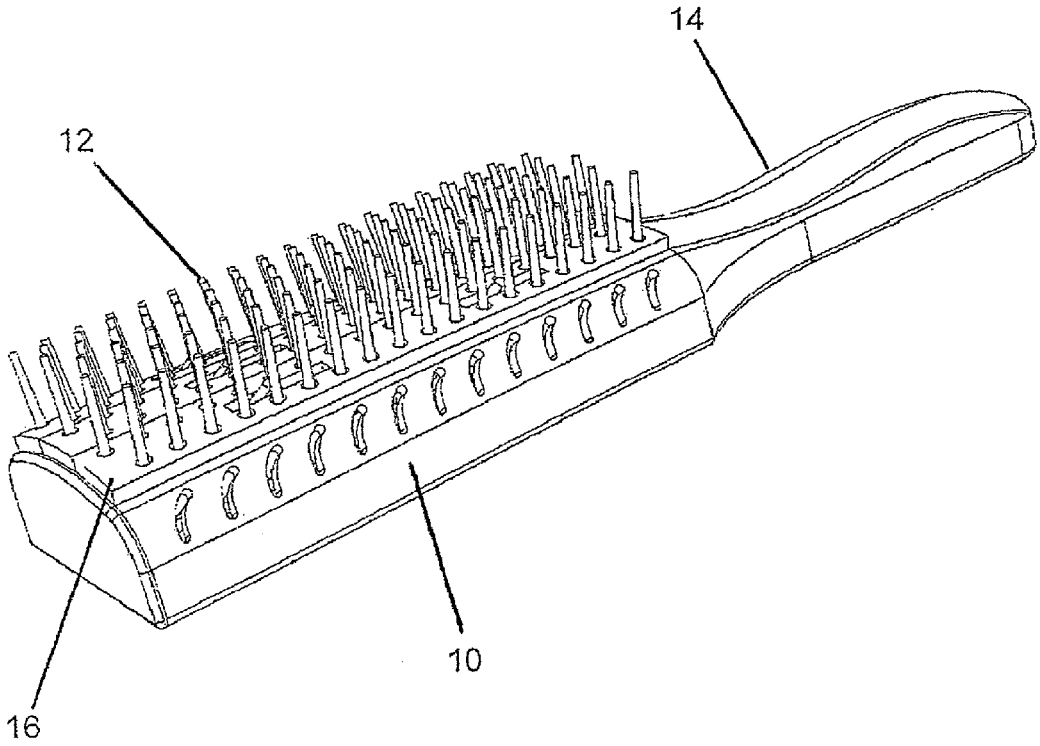
FIG. 1 is a schematic perspective view of the preferred embodiment of the present invention in a brushing position.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

In the preferred embodiment of the present invention, referring to FIG. 1, the hair brush has a hollow body 10 supporting numerous bristles 12 and a handle 14 connected to the body. The brush also has plate(s) 16 that are positioned flush to the brush body 10 such that the bristles 12 protrude through numerous openings 20 in the plate(s) 16. As the brush is used, hairs may become lodged among the bristles 12. The brush may then be cleaned by pulling the control element 18 outward, which moves the plate(s) 16, outward toward the tips of the bristles 12, thus pushing the entangled hair away from the body 10 and off the bristles 12.

Figure 2:
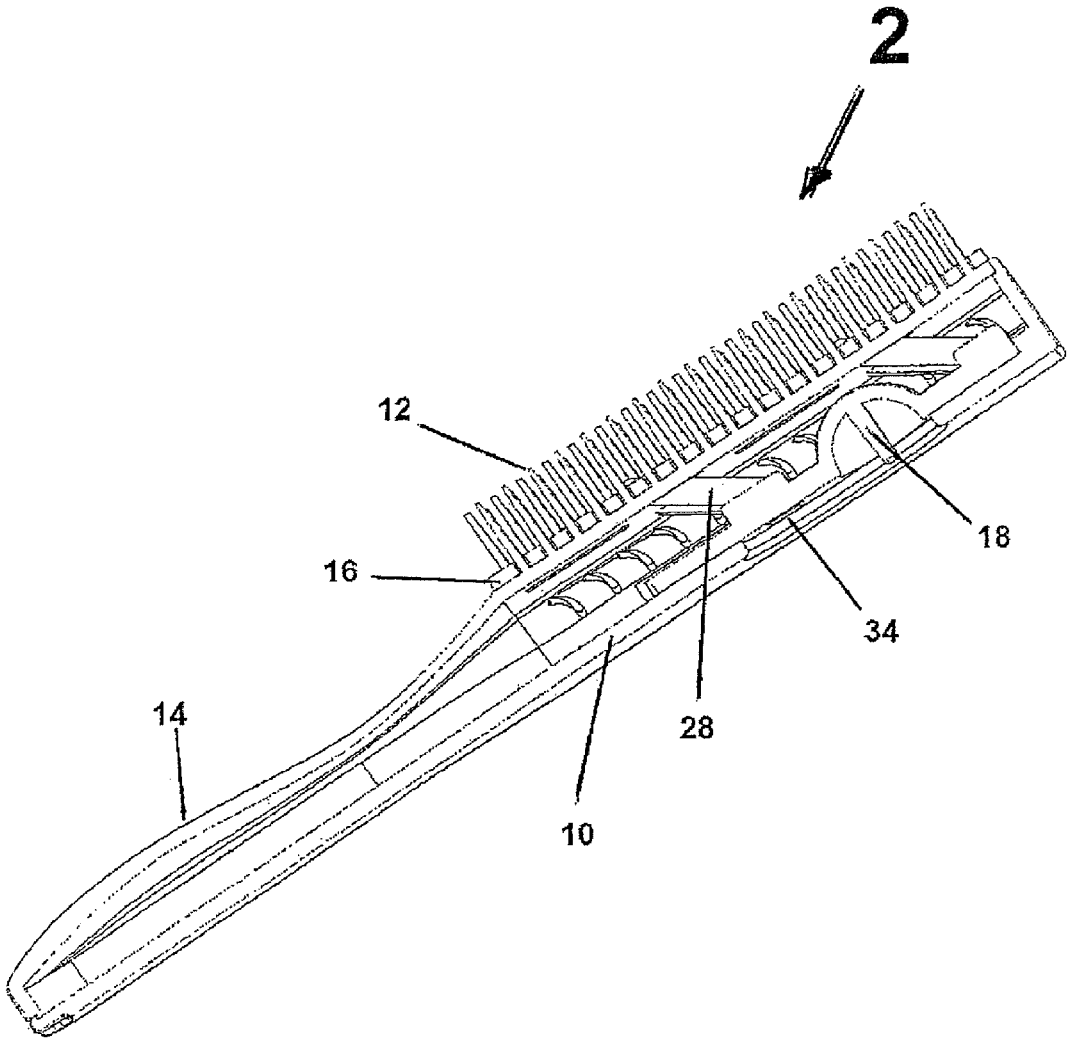
FIG. 2 is a cut away view of the preferred embodiment of the present invention showing the components thereof.
Figure 3:
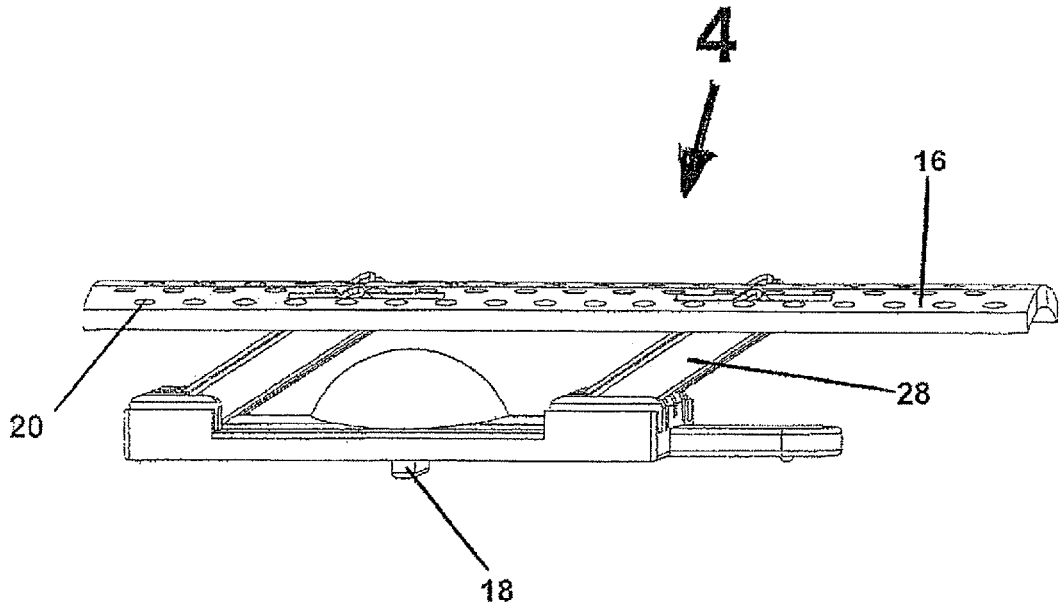
FIG. 3 is a partially exploded view of the preferred embodiment of the present invention showing the cleaning element components thereof with the hollow based body removed for clarity.

Referring to FIGS. 2 and 3, the hair brush can be comprised of three elements: a brushing element 2, a cleaning element 4, and a control element 18. The brushing element 2 has a hollow body 10 supporting an array of bristles 12, and handle 14. The body 10 is of a generally rectangular shape. The handle 14 is hollow. The handle 14 can be integrally formed with the body 10.

The body 10, handle 14, cleaning element 4, and control element 18, can be constructed from any substantially rigid material such as plastic, rubber, wood or metal. The bristles 12 are flexible and can be made of the same or different material as the body 10. Each bristle 12 can be a pin or clusters of pins. The bristles 12 can protrude from the body 10 at an angle instead of perpendicularly. The bristles 12 can be arranged in an array of straight columns and rows or arranged in an array of staggered rows.

The cleaning element 4 has plate(s) 16 and plate lifters/rib arms 28. The plate(s) 16 are of the same general shape as the body 10 of the brushing element and have an array of openings 20, such that the bristles 12 are disposed through the openings 20. Each opening 20 can receive only one bristle 12. The plate lifters/rib arms 28 are positioned within the hollow body 10 of the brushing element. The plate lifters/rib arms 28 are attached to the control element 18 and then to each plate(s) 16.

The control element 18 is housed within the body of the brushing element 2. It is a flat shaped slide plate with slotted opening which allow for it to be attached to the plate lifters/rib arms 28.

Figure 4:
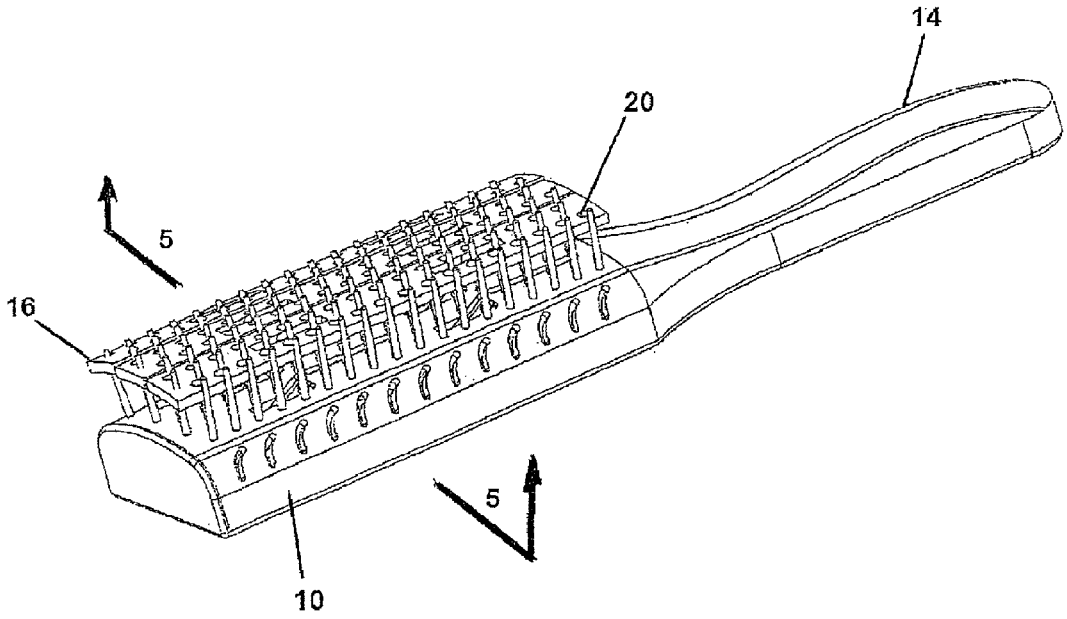
FIG. 4 is a schematic perspective view of the preferred embodiment of the present invention in the maximum cleaning position.

Referring to FIG. 4, after using the brush, the brush can be cleaned by sliding the control element 18 inward. Sliding the control element 18 inward pulls the plate lifers/rib arms 28 inward which move the plate(s) 16 outward to the tips of the bristles 12. The control element is guided within the body of the brushing element 2. When the control element 18 is inward, the plate(s) 16 of the cleaning element 2 is approximately even with the tips of the bristles 12, such that the outer surface of the plate(s) 16 clears the tips of the bristles 12 while the inner surface of the plate(s) 16 remains engaged with the tips of the bristles 12. Thus the plate(s) 16 pushes any hairs that were entwined in the bristles 12 to the tips of the bristles 12 where hairs fall off or are removed. As a consequence the present design provides a means for varying a useful-length of respective bristles 12 and for cleaning bristles 12 using the presently noted plates 16, at least in part. The control element 18 is returned to a brushing position, where the bristles 12 protrude through the plate(s) 16, by sliding outward the control element 18 in the body of the brush element 2 until the plate(s) 16 are flush with the brushing element 2.

Figure 5:
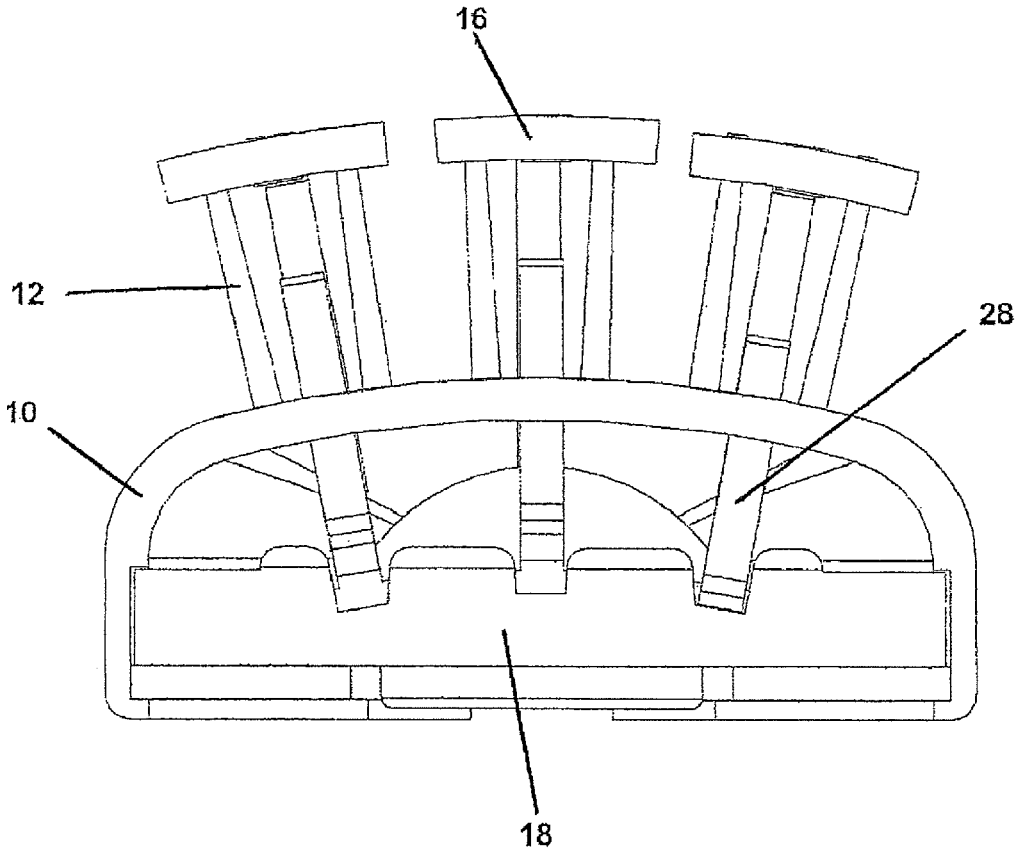
FIG. 5 is a cross-sectional view of the preferred embodiment of the present invention along the line 5-5 of FIG. 4 shown in a maximum cleaning condition.
Figure 6:
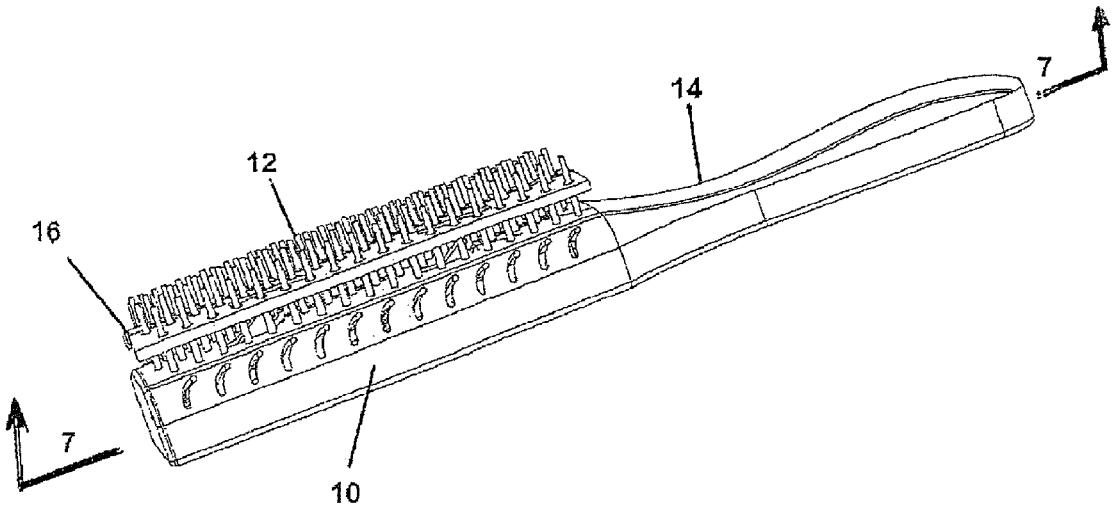
FIG. 6 is a schematic perspective view of the preferred embodiment of the present invention in an alternate brushing use position.

Referring now to FIG. 5, wherein a partial cross-sectional view along line 5-5 in FIG. 4 notes bristles 12 extending radially outwardly from a central portion of brush head element and hollow body 10. As can also be seen from reviewing FIG. 3, cantilever portions extending from plate(s) 16 contact respective plate lifters/rib arms 28 and move plates 16 radially outwardly along the direction of each bristle.

Those of skill in the art will appreciate that openings 20 may be of any shape effective to achieve the goals of the present invention. As a consequence of this realization, while holes 20 are show to be substantially circular in FIG. 3, those of skill in the art will appreciate that various shaped openings may be used, including oblong, ovoid, rectilinear, tapered along a depth of plate(s) 16, and other shapes effective to both clean hair from bristles 12 and minimizing flexing of bristles 12 during a motion of plate(s) 16 along the length of each bristle. As a consequence, it will be appreciated in FIG. 5, that plate(s) 16 are not intended to cause flexing of bristles 12 during operation, thus improving hair removal and bristle life.

It will also be noted from FIG. 5, that where plate(s) 16 end along a row of bristles 12, holes 20 may partially exist on each respective plate (for example as a ½-circle or semi-ovoid). Thus, as noted in FIG. 1, plate(s) 16 may have joints between rows of bristles 12, and as noted in FIGS. 4 and 5, plate(s) 16 may have joints that end on a row of bristles 12, all without departing from the scope and spirit of the present invention. Since plate(s) 16 operate along a length of respective bristles 12 either construction will operate effectively to remove hair and to moderate/adjust a useful bristle length, as will be discussed below.

The brush has multiple brushing positions. The cleaning element 4 can be raised so that its plate(s) 16 is/are substantially flush with the body 10 of the brushing element 2. In this position, the bristles 12 are at their full length. To set the brush to this first brushing position, the control element 18 is positioned within the lowest of the notched 34 steps. The control element 18 is set by pulling the control element 18 in the appropriate direction to the targeted notch 34. In addition, the plate(s) 16 can be adjusted to a plurality of intermediary fixable positions between the first brushing position (FIG. 1) and the cleaning position (FIG. 4). For example, the four intermediary positions set the plate(s) 16 at varying distances, e.g. ⅕ and ⅖ distance from the body 10. The effect of the intermediary positions is to vary the usable and operable length of respective bristles 12, i.e. long, medium and short.

Figure 7:
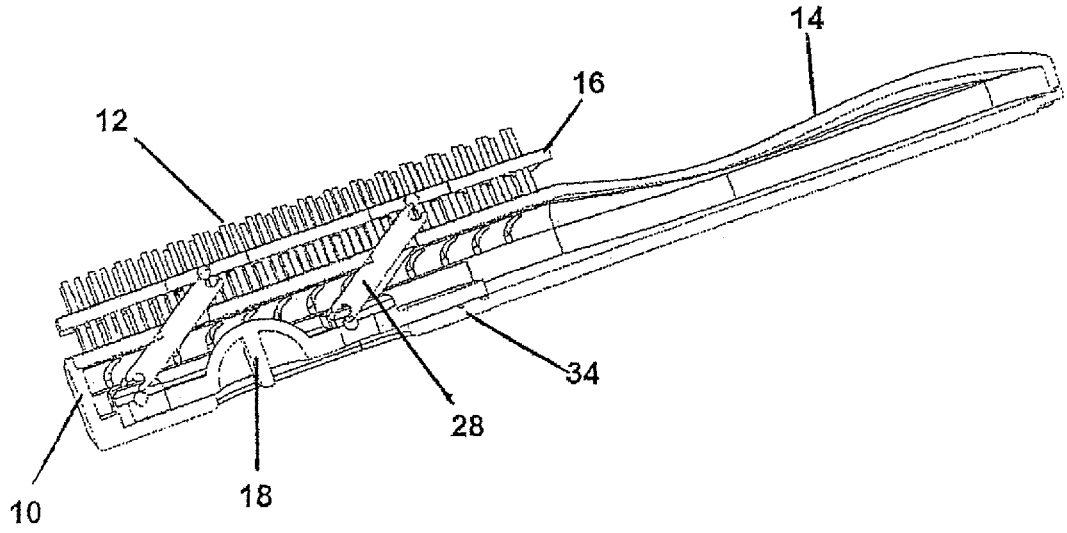
FIG. 7 is a schematic cross-sectional view of the preferred embodiment of the present invention along the line 7-7 of FIG. 6.

Referring now to FIG. 7, when the parallel shaft is set to the notch 1, the plate(s) 16 is/are secured away from the body 10 at a distance of approximately ⅕ the full length of the bristles. Setting the control element/slide plate 18 to level 1 effectively reduces the bristles 12 to a short length. The combination of the control element/slide plate 18 and the notched 34 opening forms a locking mechanism because when the control element/slide plate 18 is disposed within any of the notches 34, the cleaning element 4 is locked in position.

From any brushing position the brush can be cleaned by sliding/pushing the control element 18 inwardly away from the brush head, which in turn moves the cleaning element 4, plate(s) 16 to the tips of the bristles 12 thereby removing the entangled hairs. After cleaning the brush, the plate(s) 16 of the cleaning element 4 are returned to a brushing position by sliding/pushing the control element 18 outward to the desired bristles 12 length.

As a consequence of the present description, in combination with the drawings, it should be readily understood by those of skill in the art that an operation of the cleaning elements relative to the brushing elements enables a mechanism or system for stripping or removing loose hair from bristles 12 in a direction substantially parallel to a bristle direction without requiring a bending or flexing of the bristles thereby minimizing a bristle flex stress during a cleaning step.

Figure 8:
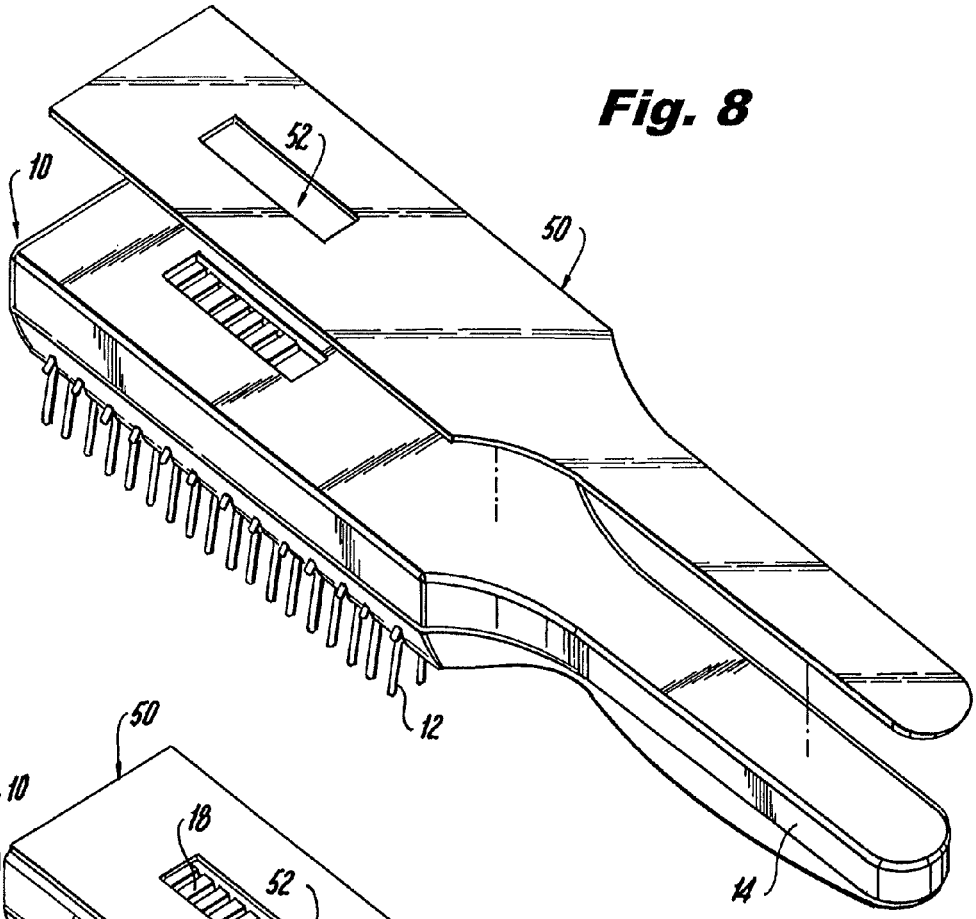
FIG. 8 is a partially exploded perspective view of the preferred embodiment of the present invention showing the mirror in relation to the back side of the brush.
Figure 9:
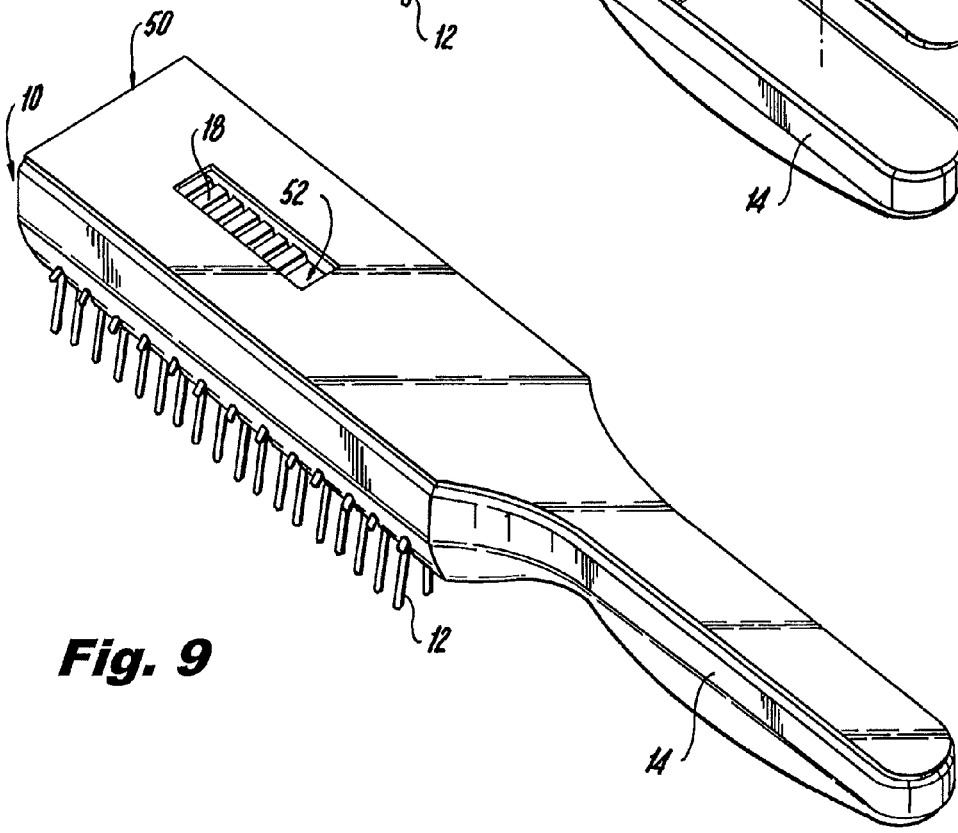
FIG. 9 is a perspective view of the preferred embodiment of the present invention showing the mirror attached to the brush.

With reference now to FIGS. 8 and 9, the brush advantageously includes a mirror 50 which is attached to the body 10 of the brush opposite bristles 12 (i.e., the back of the brush). An aperture 52 defined through mirror 50 allows a user to access control element 18 for use as described above. Mirror 50 extends along substantially all of the length of the brush, including handle 14. However, those skilled in the art will readily appreciate that a mirror could be provided along only a portion of the back of the brush without departing from the spirit and scope of the invention. Mirror 50 can be used, for example, by a person brushing their hair to view their face and hair before, during and/or after brushing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the part of the inventions, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A self-cleaning hair brush comprising, in combination:

a brushing element including a body, a plurality of bristles supported by the body and a handle supported by the body;

a cleaning element including at least one plate with a plurality of openings positioned relative to the bristles, and at least one pair of substantially parallel lifter arms which supports the at least one plate plate and is disposed within the body of the brushing element; and a control element/slide plate engaged with the lifter arms of the cleaning element which allows for the sliding of the control element/slide plate within the body of the brushing element, wherein the control element/slide plate forms a four bar parallelogram linkage with the at least one plate and the at least one pair of lifter arms of the cleaning element;

a mirror joined to the body of the brushing element on a side opposite the plurality of bristles.

2. The hair brush, according to claim 1, wherein the cleaning element is moveable with respect to the brushing element between a brushing position and a cleaning position, in the brushing position the at least one plate is/are flush with the brushing element such that the plurality of bristles protrude through the plurality of openings in the at least one plate.

3. The hair brush, according to claim 2, wherein in the cleaning position the at least one plate is/are situated about the tips of the bristles in a maximum cleaning position.

4. The hair brush, according to claim 2, further comprising:

a locking element within the control element/slide plate and the cleaning element to selectively lock the cleaning element in at least on intermediate position between the brushing position and the cleaning position producing different effective length of bristles at each intermediate position.

5. The hair brush, according to claim 2, further comprising:

means for locking the control element/slide plate relative to the cleaning element to selectively maintain at least one intermediate position so that the cleaning element is movable between the intermediate position and the cleaning position upon operation of the control element/slide plate.

6. The hair brush, according to claim 5, further comprising:

means for returning the cleaning element to a locked intermediate position after the control element/slide plate has been operated to a maximum cleaning position.

7. The hair brush, according to claim 1, wherein the cleaning element is movable with respect to the brushing element between a brushing position and a cleaning position, wherein the cleaning element is movable responsive to an external force applied to the control element/slide plate.

8. The hair brush, according to 7, wherein the cleaning element is movable responsive to release of external force applied to the control element/slide plate.

9. The hair brush, according to claim 1, where in the plurality bristles are disposed in staggered rows.

10. A brush, comprising:

a handle portion and a bristle head portion arranged in-line along a long direction of said brush;

a plurality of bristles on said bristle head portion projecting outwardly in a bristle direction generally orthogonal to said long direction of said brush;

said bristles having at least a first use-length available for brushing during a use of said brush;

means for removing external hair from said bristles following said use; and said means for removing including at least a first cleaning element including a four bar parallelogram linkage configured to move a plate of the first cleaning element outwardly along said bristle direction, thereby minimizing a risk of bristle damage;

a mirror joined to the handle and the bristle head portions on a side opposite the plurality of bristles.

11. A brush, according to claim 10, further comprising:

means for selecting between said first use-length and at least a second use-length of at least one of said plurality of bristles during said use, whereby at least one alternate bristle use-length is available.

12. A brush, according to claim 11, further comprising:

lock means for releasably and lockably selecting between at least said first and said second use-length of said bristles during a use, thereby increasing a convenience of said brush.

13. A brush, according to claim 12, further comprising:

a control element/slide plate assembly means for elastically urging said at least first cleaning element inwardly along said bristle direction;

said control element/slide plate assembly including a control element/slide plate operable in both said lock means for releasably and lockably selecting means;

said control element/slide plate operable along said long direction of said brush, and being one bar of the four bar parallelogram linkage of the first cleaning element; and said control element/slide plate enabling a ready positioning of said at least first cleaning element to establish at least said first and said second use-lengths of said bristles.

14. A brush comprising:

a brush body including a plurality of bristles extending therefrom;

a cleaning plate having a plurality of openings therethrough, the cleaning plate being engaged with the plurality of bristles wherein individual bristles extend through the opening in the cleaning plate;

a pair of substantially parallel lifter arms rotatably engaged with the cleaning plate; and a slide plate rotatably engaged with each of the lifter arms and slidingly engaged with the brush body, wherein the slide plate, lifter arms, and cleaning plate form a four bar parallelogram linkage configured to move the cleaning plate between a first position adjacent the brush body and a second position spaced apart from the first position for cleaning the bristles by movement of the slide plate relative to the brush body; a mirror joined to the body of the brushing element on a side opposite the plurality of bristles.

* * * * *